US005230642A

United States Patent [19]

Schempp

[11] Patent Number: 5,230,642

[45] Date of Patent: Jul. 27, 1993

[54] PRESS-FIT CONTACT

[75] Inventor: Otto Schempp, Bad Rappenau, Fed. Rep. of Germany

[73] Assignee: Molex Incorporated, Lisle, Ill.

[21] Appl. No.: 908,629

[22] Filed: Jun. 29, 1992

Related U.S. Application Data

[63] Continuation of Ser. No. 749,003, Aug. 22, 1991, abandoned.

[30] Foreign Application Priority Data

Aug. 22, 1990 [DE] Fed. Rep. of Germany ... 9012094[U]

[51] Int. Cl.[5] ..... H01R 13/05

[52] U.S. Cl. ..... 439/751; 439/82; 439/825

[58] Field of Search ..... 439/82, 751, 825, 826, 439/827

[56] References Cited

U.S. PATENT DOCUMENTS

| | | | |
|---|---|---|---|
| 2,036,759 | 4/1936 | Kleinmann | 439/825 |
| 2,064,545 | 12/1936 | Kleinmann et al. | 439/825 |
| 3,634,819 | 1/1972 | Evans | 439/82 |
| 4,486,068 | 12/1984 | Ghigliotti et al. | 439/825 |
| 4,596,437 | 6/1986 | Rush | 439/82 |
| 4,720,268 | 1/1988 | Weiss | 439/82 |

FOREIGN PATENT DOCUMENTS

| | | | |
|---|---|---|---|
| 524729 | 5/1931 | Fed. Rep. of Germany | 439/825 |
| 275708 | 8/1927 | United Kingdom | 439/825 |
| 1088235 | 10/1967 | United Kingdom | 439/825 |

*Primary Examiner*—Gary F. Paumen
*Attorney, Agent, or Firm*—A. A. Tirva

[57] ABSTRACT

A press-fit contact is disclosed for insertion into a plated-through hole in a printed circuit board. The press-fit contact is rotationally symmetric (manufactured on a lathe). In order to secure a uniform contact pressure for the whole contact region, the press-in portion of the contact is formed in the shape of a convex barrel and includes an axially extending cylindrical cavity. The barrel-shaped walls are provided with longitudinal slots extending parallel to the axis of the contact. The slots do not extend up to the lower end of the contact defining resilient beams having their ends joined by a rim formed at the tip of the contact.

5 Claims, 1 Drawing Sheet

PRESS-FIT CONTACT

This is a continuation of copending application Ser. No. 07/749,003 filed on Aug. 22, 1991, now abandoned.

FIELD OF THE INVENTION

The invention relates to a press-fit contact produced as a machined part for establishing an electrical connection, for example in a plate-through hole of a printed circuit board, for plug-in connections or else an attachment point for a soldered connection.

BACKGROUND OF THE INVENTION

In the case of conventional press-fit contacts it is desirable to have as uniform a contact pressure as possible over the entire region of contact between the pressed-in contact and the surrounding contact medium. Due to production inaccuracies and/or tolerance built-ups or else because of axial misalignment in the pressing-in of the contact region different current carrying or wearing occurs in the contact region between the inserted contact and the contact hole.

SUMMARY OF THE INVENTION

The object of the invention is to improve press-fit contacts in such a way that a uniform bearing pressure and uniform wear are ensured over the entire contact region.

In accordance with the present invention a press-fit contact is machined from solid round stock and includes at one end a press-in portion formed in a U-shape of a barrel having along its longitudinal outer periphery a convex shape. The press-in portion includes a cylindrical cavity extending from the tip of the portion axially the length of the portion. The press-in portion further includes a number of axially parallel longitudinal slots extending partially along the press-in portion defining between them a plurality of resilient beams each beam having one end terminating in an annular ring formed at the tip of the press-in portion.

BRIEF DESCRIPTION OF THE DRAWINGS

An embodiment of the invention is explained below with reference to the drawing, in which.

DETAILED DESCRIPTION

Figure 1:
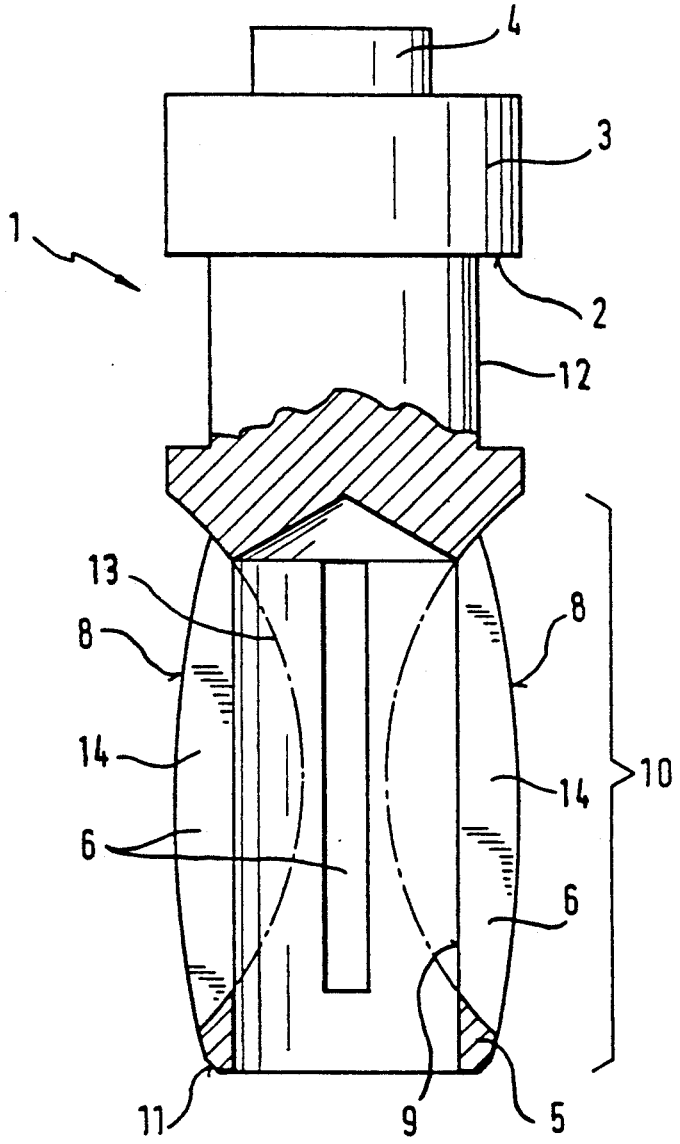
FIG. 1, shows a partial sectional side view of a press-fit contact having features according to the invention, in an enlarged representation.
Figure 2:
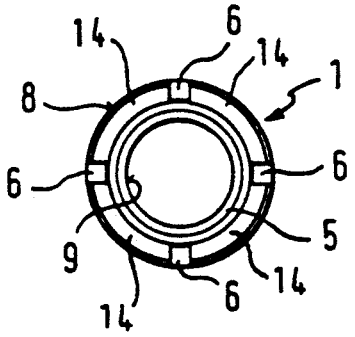
FIG. 2, shows a bottom view of the press-fit contact according to FIG. 1.

A press-fit contact 1, as shown in FIG. 1 is machined from a solid round bar of stock to form an elongated body having an annular flange 3 at one end and a press-in portion 10 at the other end. A shank 12 having a diameter smaller than the diameter of the flange 3 joins the flange 3 to the press-in portion 10 defining shoulders 2 on the bottom surface of the flange 3. A hub 4 extends from the surface opposite to the shoulders 2 of the flange 3 which hub may be used to attach a terminal or the like to the press-fit contact 1.

The press-in portion 10 has an outer periphery formed in the shape of a convex barrel 8. A cylindrical cavity 9 extends axially from the free end of the portion 10 along its entire length. The convex barrel 8 has four longitudinal slots 6 extending from its outer surface into the cavity 9, the slots defining four resilient beams 14.

The slots 6 may be machined, as for example by utilizing a milling cutter, the cutters partial outline is shown by phantom lines 13. The longitudinal slots 6 do not extend the entire length of the convex barrel 8 such that a solid annular portion 5 remains at the tip of the barrel 8 joining the ends of beams 14.

The annular portion 5 has a tapered lead-in surface 11 to make it easier to insert the press-fit contact 1 into an opening in a printed circuit board (not shown). The insertion of the contact 1 into a hole in the printed circuit board is facilitated by the shape of the press in portion 10. The structural shape and arrangement of portion 10 which includes the convex barrel 8 with four beams 6 all joined at both ends to the press-fit contact 1 ensures that the contact area between the barrel 8 and the hole is uniformly loaded over the entire length of contact area.

In accordance with the invention, the insertion of such press-fit contacts is made easier and substantially uniform contact pressure and contact surface wear are achieved over the entire contact region.

What is claimed is:

1. A press-fit electrical contact for insertion into an aperture of a printed circuit board or the like, the contact comprising:

an annular flange portion of a predetermined diameter, a hub portion having a diameter smaller than the flange portion extending from the flange portion in a first direction, a shank portion having a diameter small than the flange portion but larger than the hub portion extending from the flange portion in a second direction, an aperture engaging portion terminating in a free end and having a shape of a convex barrel extending from the shank portion the barrel at its widest point having a diameter substantially equal to the diameter of the flange portion, the barrel including a cavity having a substantially uniform cross-section and with a diameter less than the diameter of the shank portion but larger than the diameter of the hub portion extending axially from and through the free end of the aperture engaging portion substantially up to the shank portion, the barrel having a plurality of longitudinal slots extending into the cavity, wherein the slots in combination with the cavity define a plurality of resilient beams each beam located between two adjacent slots, and the longitudinal slots extending only over a portion of the barrel such that an annular area remains at the free end of the aperture engaging portion joining together the ends of all the beams.

2. The press-fit contact as claimed in claim 1, wherein the barrel has a convex shape only on its outer periphery.

3. The press-fit contact as claimed in claim 2, wherein the cross-section of each resilient beam varies along the entire length of each beam.

4. The press-fit contact as claimed in claim 3, wherein the cross-section of each resilient beam is largest at its mid-section.

5. The press-fit contact as claimed in claim 1, wherein the hub portion is adapted to accommodate an electrical terminal.

* * * * *